US009669916B2

(12) United States Patent
Hitachi et al.

(10) Patent No.: US 9,669,916 B2
(45) Date of Patent: Jun. 6, 2017

(54) SHIP STEERING SYSTEM FOR OUT-DRIVE DEVICE

(71) Applicant: YANMAR CO., LTD., Osaka-shi, Osaka (JP)

(72) Inventors: Junichi Hitachi, Osaka (JP); Takao Nakanishi, Osaka (JP); Akiyoshi Hayashi, Osaka (JP); Jun Watanabe, Osaka (JP); Gakuji Tamura, Osaka (JP)

(73) Assignee: YANMAR CO., LTD., Osaka-Shi, Osaka (JP)

( * ) Notice: Subject to any disclaimer, the term of this patent is extended or adjusted under 35 U.S.C. 154(b) by 0 days.

(21) Appl. No.: 14/763,330

(22) PCT Filed: Dec. 13, 2013

(86) PCT No.: PCT/JP2013/083485
§ 371 (c)(1),
(2) Date: Jul. 24, 2015

(87) PCT Pub. No.: WO2014/115442
PCT Pub. Date: Jul. 31, 2014

(65) Prior Publication Data

US 2015/0353179 A1 Dec. 10, 2015

(30) Foreign Application Priority Data

Jan. 25, 2013 (JP) ..... 2013-011992

(51) Int. Cl.
*B63H 25/30* (2006.01)
*B63H 20/16* (2006.01)
(Continued)

(52) U.S. Cl.
CPC ..... *B63H 25/24* (2013.01); *B63H 20/16* (2013.01); *B63H 25/30* (2013.01); *B63H 2020/003* (2013.01)

(58) Field of Classification Search
CPC ..... B63H 25/24; B63H 25/30
(Continued)

(56) References Cited

U.S. PATENT DOCUMENTS 5,031,562 A 7/1991 Nakase et al.
7,364,482 B1 * 4/2008 Wong ..... B63H 25/28 440/1
(Continued)

FOREIGN PATENT DOCUMENTS

JP H07228294 A 8/1995
JP H0976997 A 3/1997
(Continued)

OTHER PUBLICATIONS

Extended European Search Report issued in corresponding Application No. EP13873001.5; dated Sep. 5, 2016.
(Continued)

*Primary Examiner* — Lars A Olson
*Assistant Examiner* — Jovon Hayes
(74) *Attorney, Agent, or Firm* — Cantor Colburn LLP

(57) ABSTRACT

In a ship steering system for an out-drive device including: an out-drive device; a hydraulic actuator configured to turn the out-drive device; a hydraulic controller configured to control the hydraulic actuator; a ship steering device configured to instruct a traveling direction to the hydraulic controller; and an emergency ship steering device capable of at least instructing the out-drive device to turn, the emergency ship steering device is capable of controlling the hydraulic actuator without involving the hydraulic controller.

5 Claims, 7 Drawing Sheets

(51) Int. Cl.
*B63H 25/24* (2006.01)
*B63H 20/00* (2006.01)

(58) Field of Classification Search
USPC ..... 114/144 R; 440/1
See application file for complete search history.

(56) References Cited

U.S. PATENT DOCUMENTS

| | | | | |
|---|---|---|---|---|
| 2003/0033969 | A1 | 2/2003 | Doetsch | |
| 2007/0197110 | A1 | 8/2007 | Takada et al. | |
| 2015/0353179 | A1* | 12/2015 | Hitachi ..... | B63H 25/24<br>114/144 R |

FOREIGN PATENT DOCUMENTS

| | | | | |
|---|---|---|---|---|
| JP | 10007090 | A | * | 1/1998 |
| JP | 2001001992 | A | * | 1/2001 |
| JP | 2008247377 | A | * | 10/2008 |
| JP | 2013010447 | A | * | 1/2013 |

OTHER PUBLICATIONS

International Search Report corresponding to Application No. PCT/JP2013/083485; Date of Mailing: Mar. 18, 2014, with English translation.

* cited by examiner

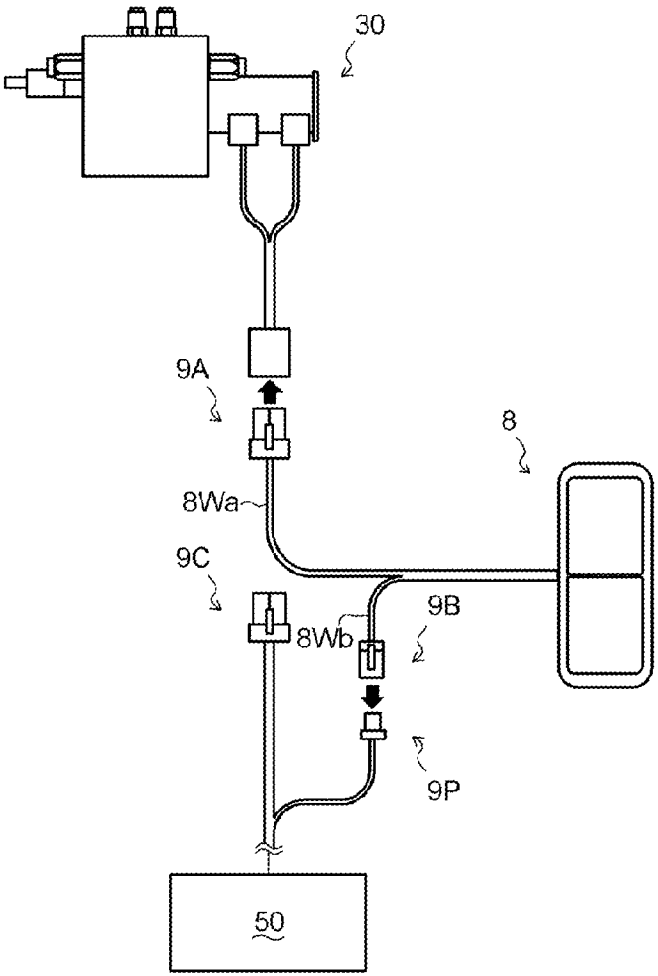
Fig. (7b)
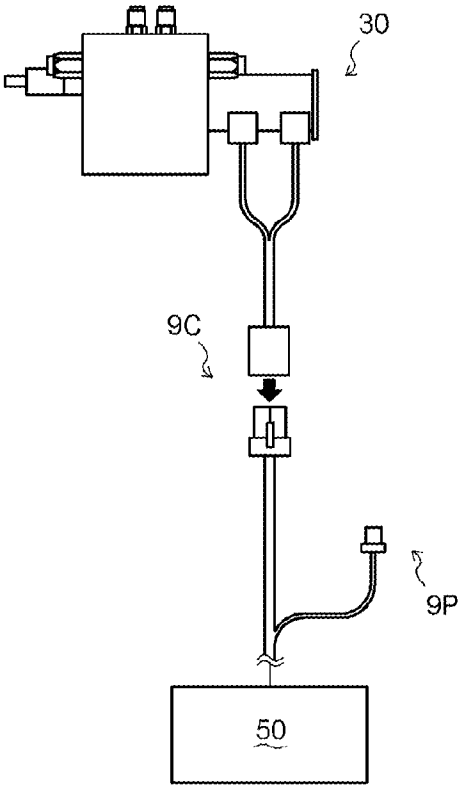
Fig. (7a)

SHIP STEERING SYSTEM FOR OUT-DRIVE DEVICE

This is the U.S. national stage of application No. PCT/JP2013/083485, filed on Dec. 13, 2013. Priority under 35 U.S.C. §119(a) and 35 U.S.C. §365(b) is claimed from Japanese Application No. 2013-011992, filed Jan. 25, 2013, the disclosure of which is also incorporated herein by reference.

TECHNICAL FIELD

The present invention relates to a technique for a ship steering system for an out-drive device.

BACKGROUND ART

Inboard and outboard devices (such as an inboard engine and an outboard drive) as an engine disposed in a ship body and an out-drive device that is disposed outside the ship body and receives force transmitted from the engine have conventionally been known (see, for example, Patent Literature 1). The out-drive device is a propulsion device that propels the ship body by rotating a screw propeller, and is also a steering device that turns the ship body by turning with respect to a traveling direction of the ship body.

A ship steering system for an out-drive device includes a hydraulic actuator and a hydraulic controller, in addition to the out-drive device described above. The ship steering system for an out-drive device further includes a ship steering device including a steering wheel, a joystick, and the like. In the ship steering system for an out-drive device, the hydraulic controller controls the hydraulic actuator in accordance with an operation on the ship steering device. The hydraulic actuator turns the out-drive device (see, for example, Patent Literature 2).

In conventional ship steering systems for an out-drive device, steering control through the hydraulic controller stops as soon as the hydraulic controller fails and is unable to control the hydraulic actuator. Thus, the conventional ship steering systems for an out-drive device have a problem that the steering is disabled as soon as the hydraulic controller fails and becomes unable to control the hydraulic actuator.

CITATION LIST

Patent Literature

PTL 1: Japanese Unexamined Patent Application Publication No. 2001-1992

PTL 2: Japanese Unexamined Patent Application Publication No. 1998-7090

SUMMARY OF INVENTION

Technical Problem

The present invention is made in view of the problem described above, and an object of the present invention is to provide a technique of being capable of continuing steering control even when a hydraulic controller fails and becomes unable to control a hydraulic actuator.

Solution to Problem

A first aspect of the present invention is a ship steering system for an out-drive device including:

an out-drive device;

a hydraulic actuator configured to turn the out-drive device;

a hydraulic controller configured to control the hydraulic actuator;

a ship steering device configured to instruct a traveling direction to the hydraulic controller; and an emergency ship steering device capable of at least instructing the out-drive device to turn, in which the emergency ship steering device is capable of controlling the hydraulic actuator without involving the hydraulic controller.

A second aspect of the present invention is the ship steering system for an out-drive device according to the first aspect further including an electromagnetic hydraulic control valve configured to change a flowing direction of hydraulic oil to the hydraulic actuator, in which the emergency ship steering device is configured to be capable of controlling the hydraulic actuator by operating the electromagnetic hydraulic control valve.

A third aspect of the present invention is the ship steering system for an out-drive device according to the second aspect further including a connection terminal configured to detachably connect between wiring of the emergency ship steering device and wiring of the electromagnetic hydraulic control valve, in which the connection terminal enables the emergency ship steering device to be detachable from the electromagnetic hydraulic control valve.

A fourth aspect of the present invention is the ship steering system for an out-drive device according to the third aspect further including a connection terminal configured to detachably connect between wiring of the hydraulic controller and wiring of the electromagnetic hydraulic control valve, in which the emergency ship steering device becomes available when the wiring of the emergency ship steering device is connected to the wiring of the electromagnetic hydraulic control valve through the connection terminal.

A fifth aspect of the present invention is the ship steering system for an out-drive device according to any one of the first to the third aspects further including a main controller configured to be capable of recognizing failure of the hydraulic controller, in which the emergency ship steering device becomes available when the main controller recognizes the failure of the hydraulic controller.

Advantageous Effects of Invention

The present invention has the following advantageous effects.

In the first aspect, the ship steering system for an out-drive device includes the emergency ship steering device capable of at least instructing the out-drive device to turn, and the emergency ship steering device is capable of controlling the hydraulic actuator without involving the hydraulic controller. Thus, the ship steering system for an out-drive device can continue the steering control, even when the hydraulic controller fails and thus cannot control the hydraulic actuator.

In the second aspect, the ship steering system for an out-drive device includes the electromagnetic hydraulic control valve configured to change the flowing direction of hydraulic oil to the hydraulic actuator, and the emergency ship steering device is configured to be capable of controlling the hydraulic actuator by operating the electromagnetic hydraulic control valve. Thus, the ship steering system for an out-drive device can continue the steering control, even when the hydraulic controller fails and thus cannot control the hydraulic actuator.

In the third aspect, the ship steering system for an out-drive device includes the connection terminal configured to detachably connect between the wiring of the emergency ship steering device and the wiring of the electromagnetic hydraulic control valve, and the connection terminal enables the emergency ship steering device to be detachable from the electromagnetic hydraulic control valve. Thus, in the ship steering system for an out-drive device, the emergency ship steering device can be independently detached to be separately stored.

In the fourth aspect, the ship steering system for an out-drive device includes the connection terminal configured to detachably connect between the wiring of the hydraulic controller and the wiring of the electromagnetic hydraulic control valve, and the emergency ship steering device becomes available when the wiring of the emergency ship steering device is connected to the wiring of the electromagnetic hydraulic control valve through the connection terminal Thus, in the ship steering system for an out-drive device, the control on the hydraulic actuator through the hydraulic controller and the control on the hydraulic actuator by the emergency ship steering device not involving the hydraulic controller are not confused with each other.

In the fifth aspect, the ship steering system for an out-drive device includes a main controller configured to be capable of recognizing failure of the hydraulic controller, and the emergency ship steering device becomes available when the main controller recognizes the failure of the hydraulic controller. Thus, in the ship steering system for an out-drive device, the control on the hydraulic actuator through the hydraulic controller and the control on the hydraulic actuator by the emergency ship steering device not involving the hydraulic controller are not confused with each other.

BRIEF DESCRIPTION OF DRAWINGS

FIGS. 7 (*a*) and (*b*) are diagrams illustrating a preparation for making the emergency ship steering device available.

DESCRIPTION OF EMBODIMENTS

Next, an embodiment of the present invention will be described.

A ship steering system 100 for an out-drive device will be briefly described.

Figure 1:
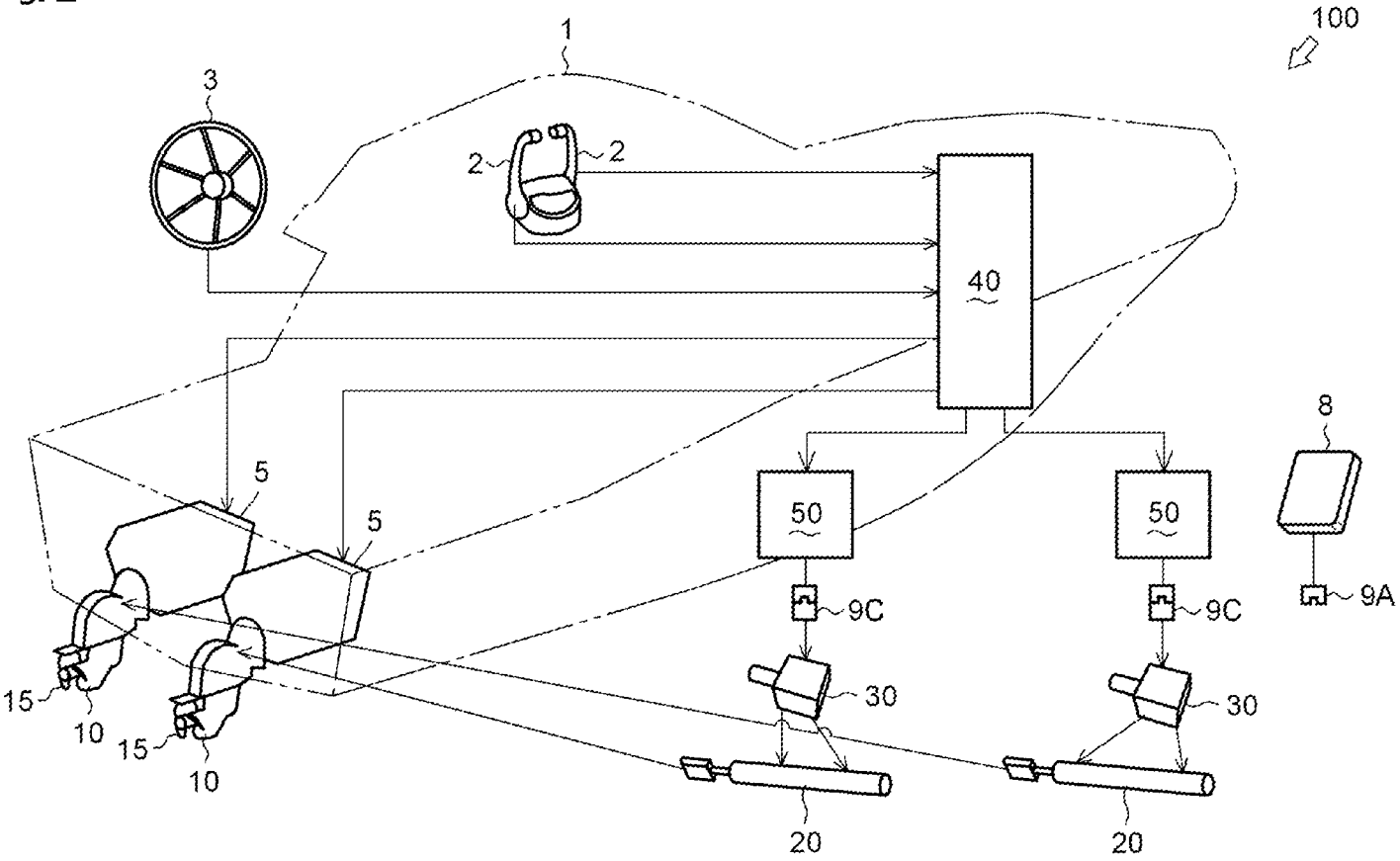
FIG. 1 is a diagram illustrating an overview of a ship steering system for an out-drive device.
Figure 2:
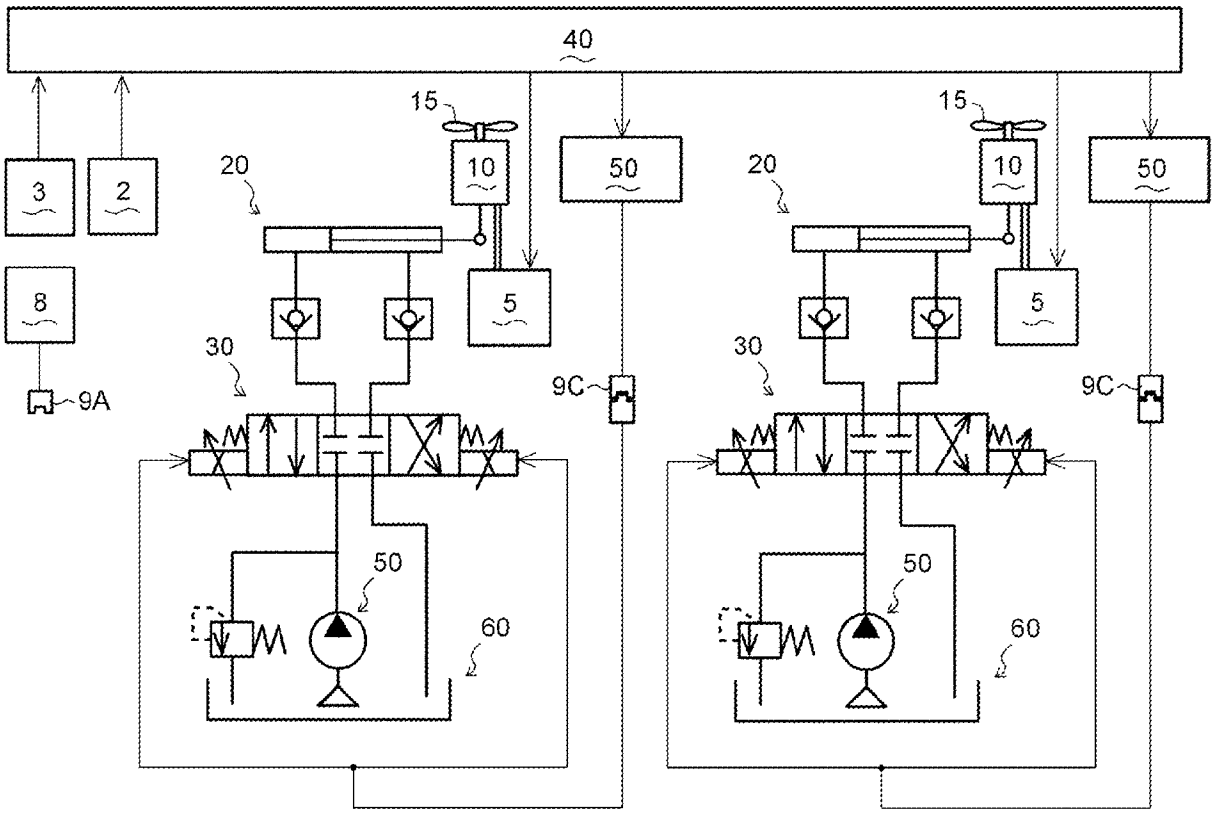
FIG. 2 is a diagram illustrating a configuration of the ship steering system for an out-drive device.

FIG. 1 is a diagram illustrating an overview of the ship steering system 100 for an out-drive device. FIG. 2 is a diagram illustrating a configuration of the ship steering system 100 for an out-drive device. A ship according to the present embodiment includes two out-drive devices 10 and thus employs what is known as a dual shaft propulsion system. However, the ship is not limited to this and may employ a single shaft propulsion system for example.

The ship steering system 100 for an out-drive device can adjust an operation state of an engine 5 and thus can change a rotation speed of a screw propeller 15, in accordance with an operation on a throttle lever 2. The ship steering system 100 for an out-drive device can change a turning angle of the out-drive device 10 in accordance with an operation on a ship steering device 3 including a steering wheel and a joystick. The ship steering system 100 for an out-drive device including the ship steering device 3 and the like further includes the out-drive devices 10; hydraulic actuators 20; electromagnetic hydraulic control valves 30; main controllers 40; and hydraulic controllers 50.

Figure 3:
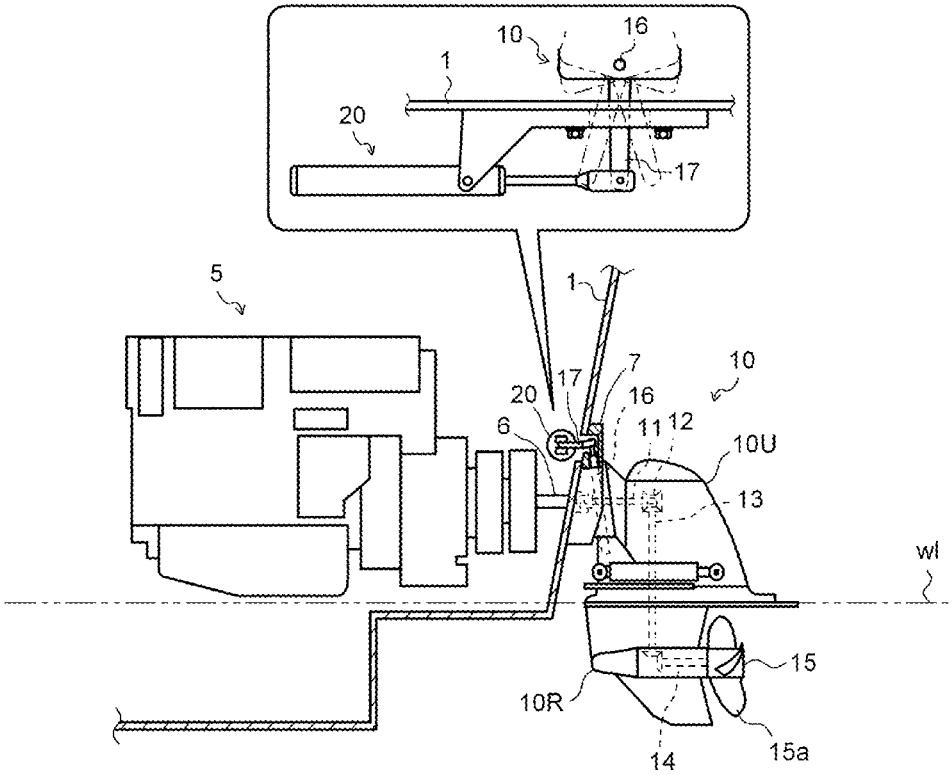
FIG. 3 is a diagram illustrating a configuration of an out-drive device.

The out-drive devices 10 rotate the screw propellers 15 to propel a ship body 1. The out-drive device 10 turns with respect to the propelled direction of the ship body 1, whereby the ship body 1 turns. As illustrated in FIG. 3, the out-drive device 10 includes an input shaft 11, a switching clutch 12, a driving shaft 13, an output shaft 14, and the screw propeller 15.

The input shaft 11 transmits rotation force, transmitted from the engine 5 through a universal joint 6, to the switching clutch 12. The input shaft 11 has one end portion coupled to the universal joint 6 attached to the output shaft of the engine 5 and the other end portion coupled to the switching clutch 12 disposed in an upper housing 10U.

The switching clutch 12 can switch between normal rotation and reverse rotation directions of the rotation force transmitted from the engine 5 through the input shaft 11 and the like. The switching clutch 12 includes a normal rotation bevel gear and a reverse rotation bevel gear that are coupled to an inner drum including a disk plate. The switching clutch 12 switches the rotation direction by determining the one of the disk plates to which a pressure plate of an outer drum, coupled to the input shaft 11, is pressed against.

The driving shaft 13 transmits the rotation force, transmitted from the engine 5 through the switching clutch 12 and the like, to the output shaft 14. The driving shaft 13 has one end portion provided with a bevel gear that meshes with the normal rotation bevel gear and the reverse rotation bevel gear of the switching clutch 12, and the other end portion provided with a bevel gear that meshes with a bevel gear of the output shaft 14 disposed in a lower housing 10R.

The output shaft 14 transmits the rotation force, transmitted from the engine 5 through the driving shaft 13 and the like, to the screw propeller 15. The output shaft 14 has one end portion provided with the bevel gear that meshes with the bevel gear of the driving shaft 13 as described above, and the other end portion to which the screw propeller 15 is attached.

The screw propeller 15 rotates to generate propulsive force. The screw propeller 15 is driven by the rotation force transmitted from the engine 5 through the output shaft 14 and the like, and includes a plurality of blades 15*a* that are arranged about a rotation shaft and generate the propulsive force by paddling peripheral water.

The out-drive device 10 is supported by a gimbal housing 7 attached to the stern (transom board) of the ship body 1. More specifically, when the out-drive device 10 is supported by the gimbal housing 7 with a gimbal ring 16 of the out-drive device 10 being substantially orthogonal to a water line w1. The gimbal ring 16 is a substantially cylindrical rotational shaft attached to the out-drive device 10. The out-drive device 10 rotates about the gimbal ring 16.

A steering arm 17 extending into the ship body 1 is attached to an upper side end portion of the gimbal ring 16. The steering arm 17 turns the out-drive device 10 about the gimbal ring 16. The steering arm 17 is driven by the hydraulic actuator 20.

Figure 4:
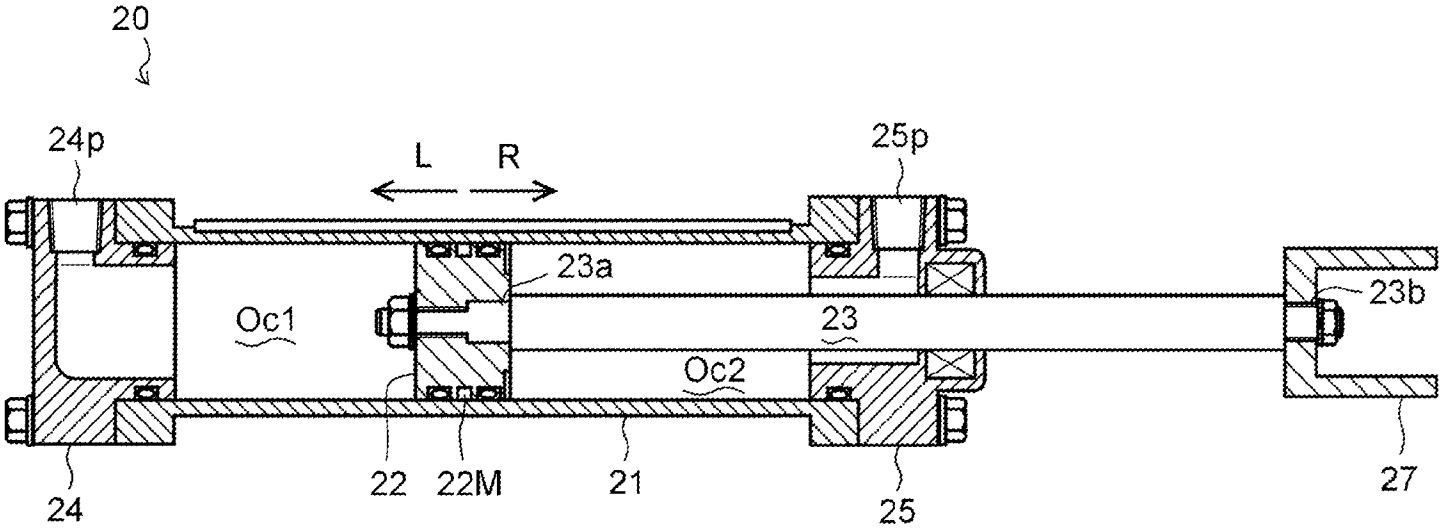
FIG. 4 is a diagram illustrating a configuration of a hydraulic actuator.

The hydraulic actuator 20 drives the steering arm 17 of the out-drive device 10, and thus turns the out-drive device 10. As illustrated in FIG. 4, the hydraulic actuator 20 mainly includes a cylinder sleeve 21, a piston 22, a rod 23, a first cylinder cap 24, and a second cylinder cap 25.

The cylinder sleeve 21 incorporates the piston 22 in a slidable manner. The cylinder sleeve 21 has both end portions provided with flange portions that protrude in a radial direction and are respectively provided with the first cylinder cap 24 and the second cylinder cap 25.

The piston 22 slides in the cylinder sleeve 21 by receiving hydraulic pressure. A ring groove is formed on an outer circumference surface of the piston 22 along the circumference direction. A seal ring is fit in the ring groove.

The rod 23 transmits sliding movement of the piston 22 to the steering arm 17. The rod 23 has one end portion provided with a small diameter portion 23*a* to which the piston 22 is fixed. The rod 23 has the other end portion provided with a small diameter portion 23*b* to which a clevis 27 is fixed. The clevis 27 is a coupling member coupling between the rod 23 and the steering arm 17.

The first cylinder cap 24 encloses one end portion of the cylinder sleeve 21. A first oil path 24*p*, in communication with a first oil chamber Oc1 defined by the cylinder sleeve 21 and the piston 22, is formed in the first cylinder cap 24. A ring groove, extending in the circumference direction, is formed on an inner wall surface of a portion fit in the cylinder sleeve 21, and a seal ring is fit in the ring groove. Thus, the first oil chamber Oc1 forms a pressure resistant chamber that can withstand predetermined hydraulic pressure.

The second cylinder cap 25 encloses the other end portion of the cylinder sleeve 21, and slidably supports the rod 23. A second oil path 25*p*, in communication with a second oil chamber Oc2 defined by the cylinder sleeve 21 and the piston 22, is formed in the second cylinder cap 25. A ring groove, extending in a circumference direction, is formed on an inner wall surface of a portion fit in the cylinder sleeve 21, and a seal ring is fit in the ring groove. Thus, the second oil chamber Oc2 forms a pressure resistant chamber that can withstand predetermined hydraulic pressure.

Figure 5:
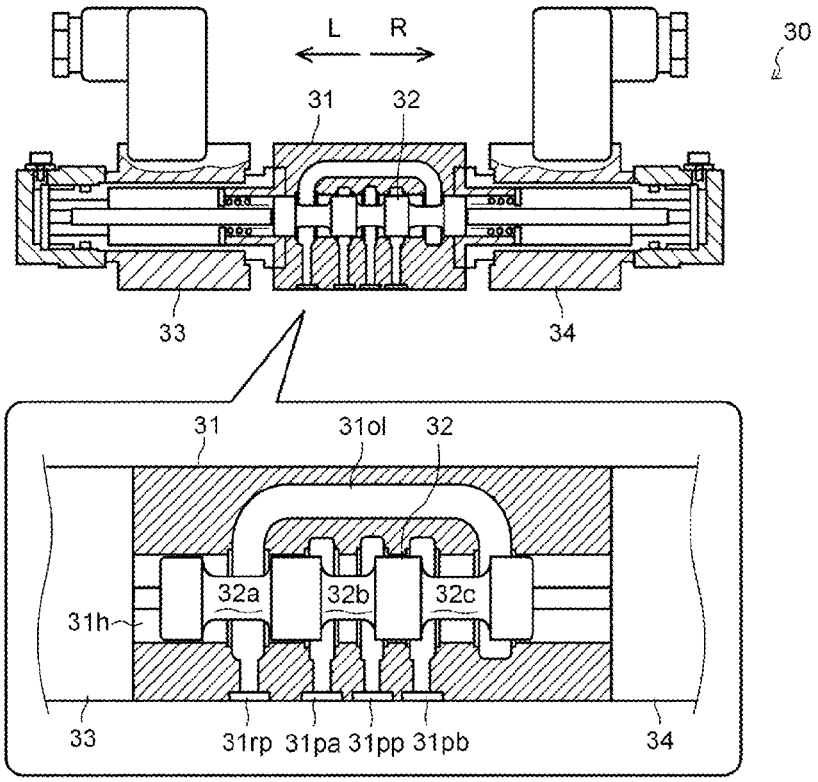
FIG. 5 is a diagram illustrating a configuration of an electromagnetic hydraulic control valve.

The electromagnetic hydraulic control valve 30 changes a flowing direction of hydraulic oil to the hydraulic actuator 20. As illustrated in FIG. 5, the electromagnetic hydraulic control valve 30 mainly includes a valve body 31, a spool shaft 32, a first solenoid 33, and a second solenoid 34. An operation system of the electromagnetic hydraulic control valve 30 is not particularly limited, and the electromagnetic hydraulic control valve 30 may be a direct electromagnetic proportional valve as in the present embodiment, or a pilot electromagnetic proportional valve.

The valve body 31 slidably incorporates the spool shaft 32. A barrel hole 31*h* is formed in the valve body 31. The barrel hole 31*h* is provided with supply and discharge ports 31*pa* and 31*pb* respectively in communication with the oil paths 24*p* and 25*p* of the hydraulic actuator 20. The barrel hole 31*h* is further provided with a pump port 31*pp* and a return port 31*rp* respectively in communication with a hydraulic oil pump 50 and a hydraulic oil tank 60. The valve body 31 is further provided with an oil path 31*ol* that communicates between the supply and discharge port 31*pb* and the return port 31*rp*, under the condition that the spool shaft 32 is at a predetermined position.

The spool shaft 32 slides in the barrel hole 31*h* to switch between the oil paths for the hydraulic oil. The spool shaft 32 includes small diameter portions 32*a*, 32*b*, and 32*c* where the outer diameter of the spool shaft 32 is reduced. The ports 31*pa*, 31*pb*, 31*pp*, and 31*rp* are in communication with each other or are blocked from each other in accordance with the sliding of the spool shaft 32.

The first solenoid 33 makes the spool shaft 32 slide in one direction. More specifically, the first solenoid 33 is disposed adjacent to one end portion of the spool shaft 32, and makes the spool shaft 32 slide based on a mechanism that an excited magnet coil attracts a movable iron core. In the present embodiment, the first solenoid 33 makes the spool shaft 32 slide in a direction indicated by an arrow R.

The second solenoid 34 makes the spool shaft 32 slide in the other direction. More specifically, the second solenoid 34 is disposed adjacent to the other end portion of the spool shaft 32, and makes the spool shaft 32 slide based on a mechanism that an excited magnet coil attracts a movable iron core. In the present embodiment, the second solenoid 34 makes the spool shaft 32 slide in a direction indicated by an arrow L.

The main controller 40 generates an output signal based on an input signal from the ship steering device 3, and transmits the generated output signal to the hydraulic controller 50. The hydraulic controller 50 generates an output signal based on the input signal from the main controller 40, and transmits the generated output signal to the electromagnetic hydraulic control valve 30. The main controller 40 can generate an output signal based on information from Global Positioning System (GPS), and can transmit the generated output signal to the hydraulic controller 50. Thus, the main controller 40 can achieve what is known as automatic navigation in which a course is calculated from the current ship position and a set destination and the ship is automatically steered, in addition to the manual ship steering by an operator.

Next, an operation mode of the ship steering system 100 for an out-drive device will be briefly described. Here, a mode is described in which the hydraulic controller 50, that is not under failure, operates the electromagnetic hydraulic control valve 30 and controls the hydraulic actuator 20 so that the hydraulic actuator 20 turns the out-drive device 10.

First of all, a case is described where the ship body 1 is turned clockwise in accordance with an operation on the ship steering device 3.

To turn the ship body 1 clockwise, the hydraulic controller 50 transmits the output signal to the electromagnetic hydraulic control valve 30 so that the first solenoid 33 operates to make the spool shaft 32 slide in one direction (the direction indicated by the arrow R illustrated in FIG. 5). As a result, the piston 22 of the hydraulic actuator 20 slides in the direction indicated by the arrow R illustrated in FIG. 4.

More specifically, the hydraulic controller 50 operates the first solenoid 33 of the electromagnetic hydraulic control valve 30 to make the spool shaft 32 slide in one direction (the direction indicated by the arrow R illustrated in FIG. 5). Thus, the supply and discharge port 31*pa* and the return port 31*rp*, as well as the supply and discharge port 31*pb* and the pump port 31*pp* of the electromagnetic hydraulic control valve 30 communicate with each other. As a result, the hydraulic oil pumped from the hydraulic oil pump 50 is supplied to the first oil chamber Oc1 through the first oil path 24*p*, and the hydraulic oil in the second oil chamber Oc2 returns to the hydraulic oil tank 60 through the second oil path 25*p*. Thus, the first oil chamber Oc1 receives higher hydraulic pressure than the second oil chamber Oc2. As a result, the piston 22, separating the first oil chamber Oc1 and the second oil chamber Oc2 from each other, slides toward the second oil chamber Oc2.

As described above, the hydraulic controller 50 makes the piston 22 slide in one direction (the direction indicated by the arrow R illustrated in FIG. 4) in accordance with an operation on the ship steering device 3. Thus, the rod 23 fixed to the piston 22 integrally slides to drive the steering arm 17, whereby the out-drive device 10 can be turned. As a result, the ship body 1 turns clockwise.

Next, a case is described where the ship body 1 is turned counterclockwise in accordance with an operation on the ship steering device 3.

To turn the ship body 1 counterclockwise, the hydraulic controller 50 transmits the output signal to the electromagnetic hydraulic control valve 30 so that the second solenoid 34 operates to make the spool shaft 32 slide in the other direction (the direction indicated by the arrow L illustrated in FIG. 5). As a result, the piston 22 of the hydraulic actuator 20 slides in the direction indicated by the arrow L illustrated in FIG. 4.

More specifically, the hydraulic controller 50 operates the second solenoid 34 of the electromagnetic hydraulic control valve 30 to make the spool shaft 32 slide in the other direction (the direction indicated by the arrow L illustrated in FIG. 5). Thus, the supply and discharge port 31*pa* and the pump port 31*pp*, as well as the supply and discharge port 31*pb* and the return port 31*rp* of the electromagnetic hydraulic control valve 30 communicate with each other. As a result, the hydraulic oil pumped from the hydraulic oil pump 50 is supplied to the second oil chamber Oc2 through the second oil path 25*p*, and the hydraulic oil in the first oil chamber Oc1 returns to the hydraulic oil tank 60 through the first oil path 24*p*. Thus, the second oil chamber Oc2 receives higher hydraulic pressure than the first oil chamber Oc1. As a result, the piston 22, separating the first oil chamber Oc1 and the second oil chamber Oc2 from each other, slides toward the first oil chamber Oc1.

As described above, the hydraulic controller 50 makes the piston 22 slide in the other direction (the direction indicated by the arrow L illustrated in FIG. 4) in accordance with an operation on the ship steering device 3. Thus, the rod 23 fixed to the piston 22 integrally slides to drive the steering arm 17, whereby the out-drive device 10 can be turned. As a result, the ship body 1 turns counterclockwise.

A case is described below where the hydraulic controller 50 has failed and thus cannot control the hydraulic actuator 20.

Figure 6:
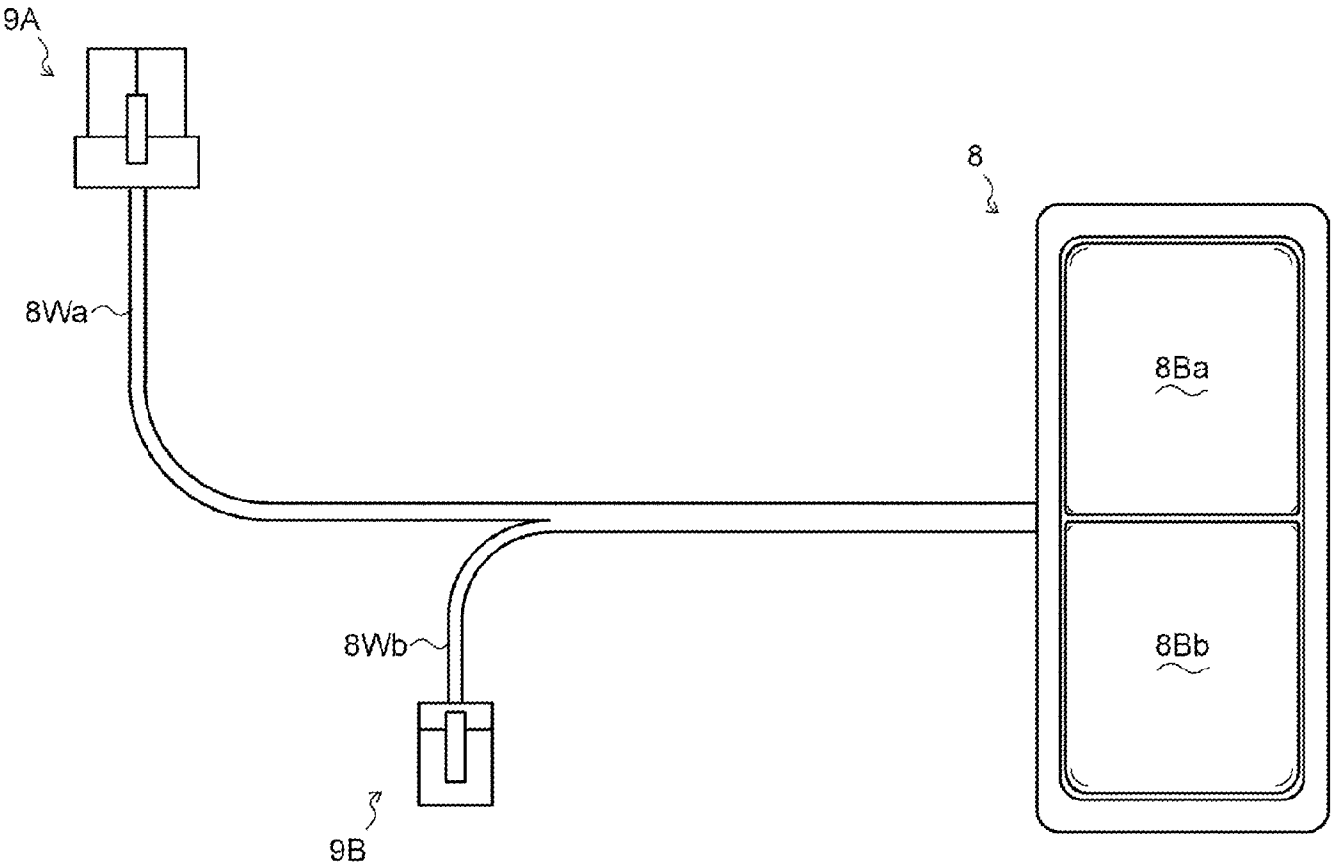
FIG. 6 is a diagram illustrating an emergency ship steering device.

FIG. 6 is a diagram illustrating an emergency ship steering device 8 stored in a bridge in the ship according to the present embodiment.

The ship steering system 100 for an out-drive device includes the emergency ship steering device 8 that can instruct the out-drive device 10 to turn. The emergency ship steering device 8 is provided with two buttons 8Ba and 8Bb. The emergency ship steering device 8 transmits an output signal based on an operation on the button 8Ba or 8Bb to the electromagnetic hydraulic control valve 30. The emergency ship steering device 8 according to the present embodiment is directly connected to the electromagnetic hydraulic control valve 30. Thus, the output signal from the emergency ship steering device 8 is transmitted directly to the electromagnetic hydraulic control valve 30 without involving the hydraulic controller 50.

When the operator presses the button 8Ba, the emergency ship steering device 8 transmits the output signal to the electromagnetic hydraulic control valve 30 so that the first solenoid 33 operates to make the spool shaft 32 slide in one direction (the direction indicated by the arrow R illustrated in FIG. 5). As a result, the piston 22 of the hydraulic actuator 20 slides in the direction indicated by the arrow R illustrated in FIG. 4.

More specifically, the emergency ship steering device 8 operates the first solenoid 33 of the electromagnetic hydraulic control valve 30 to make the spool shaft 32 slide in one direction (the direction indicated by the arrow R illustrated in FIG. 5). Thus, the supply and discharge port 31*pa* and the return port 31*rp*, as well as the supply and discharge port 31*pb* and the pump port 31*pp* of the electromagnetic hydraulic control valve 30 communicate with each other. As a result, the hydraulic oil pumped from the hydraulic oil pump 50 is supplied to the first oil chamber Oc1 through the first oil path 24*p*, and the hydraulic oil in the second oil chamber Oc2 returns to the hydraulic oil tank 60 through the second oil path 25*p*. Thus, the first oil chamber Oc1 receives higher hydraulic pressure than the second oil chamber Oc2. As a result, the piston 22, separating the first oil chamber Oc1 and the second oil chamber Oc2 from each other, slides toward the second oil chamber Oc2.

As described above, the emergency ship steering device 8 makes the piston 22 slide in one direction (the direction indicated by the arrow R illustrated in FIG. 4), in accordance with the operation of pressing the button 8Ba by the operator. Thus, the rod 23 fixed to the piston 22 integrally slides to drive the steering arm 17, whereby the out-drive device 10 can be turned.

When the operator presses the button 8Bb, the emergency ship steering device 8 transmits the output signal to the electromagnetic hydraulic control valve 30 so that the second solenoid 34 operates to make the spool shaft 32 slide in the other direction (the direction indicated by the arrow L illustrated in FIG. 5). As a result, the piston 22 of the hydraulic actuator 20 slides in the direction indicated by the arrow L illustrated in FIG. 4.

More specifically, the emergency ship steering device 8 operates the second solenoid 34 of the electromagnetic hydraulic control valve 30 to make the spool shaft 32 slide in the other direction (the direction indicated by the arrow L illustrated in FIG. 5). Thus, the supply and discharge port 31*pa* and the pump port 31*pp*, as well as the supply and discharge port 31*pb* and the return port 31*rp* of the electromagnetic hydraulic control valve 30 communicate with each other. As a result, the hydraulic oil pumped from the hydraulic oil pump 50 is supplied to the second oil chamber Oc2 through the second oil path 25*p*, and the hydraulic oil in the first oil chamber Oc1 returns to the hydraulic oil tank 60 through the first oil path 24*p*. Thus, the second oil chamber Oc2 receives higher hydraulic pressure than the first oil chamber Oc1. As a result, the piston 22, separating the first oil chamber Oc1 and the second oil chamber Oc2 from each other, slides toward the first oil chamber Oc1.

As described above, the emergency ship steering device 8 makes the piston 22 slide in the other direction (the direction indicated by the arrow L illustrated in FIG. 4) in accordance with the operation of pressing the button 8Bb by the operator. Thus, the rod 23 fixed to the piston 22 integrally slides to drive the steering arm 17, whereby the out-drive device 10 can be turned.

As described above, the ship steering system 100 for an out-drive device can continue the steering control, even when the hydraulic controller 50 fails and thus cannot control the hydraulic actuator 20, so that the turning angle of the out-drive device 10 returns to 0° (midship wheel), for example.

The emergency ship steering device 8 according to the present embodiment only has a simple structure with the two buttons 8Ba and 8Bb because it is used in a limited occasion where the hydraulic controller 50 fails. Because it is difficult to perform an accurate operation to make the turning angle of the out-drive device 10 return to 0° (midship wheel) without even a slightest displacement, the emergency ship steering device 8 may be capable of controlling the hydraulic actuator 20 based on a signal from a sensor.

A configuration where the emergency ship steering device 8 is detachable from the electromagnetic hydraulic control valve 30 is described below.

As described above, the emergency ship steering device 8 is used in a limited occasion where the hydraulic controller 50 fails. Thus, it is likely that the emergency ship steering device 8 needs not to be constantly connected to the electromagnetic hydraulic control valve 30. Thus, the emergency ship steering device 8 is detachably attached to the electromagnetic hydraulic control valve 30 with a connection terminal 9A (see FIGS. 2, 6, and 7).

Thus, in the ship steering system 100 for an out-drive device, the emergency ship steering device 8 can be independently detached to be separately stored.

Next, a preparation for using the emergency ship steering device 8 will be described.

FIG. 7 is a diagram illustrating the preparation for making the emergency ship steering device 8 available.

The emergency ship steering device 8 is provided with wiring 8Wa for connecting to the electromagnetic hydraulic control valve 30. The connection terminal 9A is attached to a distal end portion of the wiring 8Wa. The emergency ship steering device 8 is provided with wiring 8Wb for connecting to a power source. A connection terminal 9B is attached to a distal end portion of the wiring 8Wb.

First of all, the operator detaches the wiring of the hydraulic controller 50 from the wiring of the electromagnetic hydraulic control valve 30 (see FIG. 7(*a*)), by detaching a connection terminal 9C connecting between the wiring of the hydraulic controller 50 and the wiring of the electromagnetic hydraulic control valve 30.

Next, the operator connects the wiring 8Wa of the emergency ship steering device 8 to the wiring of the electromagnetic hydraulic control valve 30 (see FIG. 7(*b*)), by connecting the connection terminal 9A on a side of the emergency ship steering device 8 to the connection terminal 9C on a side of the electromagnetic hydraulic control valve 30. Then, the operator connects the wiring 8Wb of the emergency ship steering device 8 to the wiring corresponding to the power source (see FIG. 7(*b*)), by connecting the connection terminal 9B on a side of the emergency ship steering device 8 to a connection terminal 9P on a side of the power source. The emergency ship steering device 8 becomes available through the preparation described above.

Thus, the control on the hydraulic actuator 20 through the hydraulic controller 50 and the control on the hydraulic actuator 20 by the emergency ship steering device 8 not involving the hydraulic controller 50 are not confused with each other in the ship steering system 100 for an out-drive device.

As described above, the emergency ship steering device 8 becomes available after being connected to the electromagnetic hydraulic control valve 30 through the connection terminal 9A. Alternatively, the emergency ship steering device 8 may be connected to the electromagnetic hydraulic control valve 30 in advance and become available when the main controller 40 recognizes the failure of the hydraulic controller 50.

Thus, the control by the hydraulic actuator 20 through the hydraulic controller 50 and the control by the emergency ship steering device 8, not through the hydraulic controller 50, are not confused with each other in the ship steering system 100 for an out-drive device.

INDUSTRIAL APPLICABILITY

The present invention can be used in a technique for a ship steering system for an out-drive device.

REFERENCE SIGNS LIST

1 Ship body
2 Acceleration lever
3 Ship steering device
8 Emergency ship steering device
10 Out-drive device
20 Hydraulic actuator
30 Electromagnetic hydraulic control valve
40 Main controller
50 Hydraulic controller
100 Ship steering system for an out-drive device
9A Connection terminal
9C Connection terminal

The invention claimed is:

1. A ship steering system for an out-drive device comprising:

an out-drive device;

a hydraulic actuator configured to turn the out-drive device;

a hydraulic controller configured to control the hydraulic actuator;

a ship steering device configured to instruct a traveling direction to the hydraulic controller; and an emergency ship steering device capable of at least instructing the out-drive device to turn by controlling the hydraulic actuator without involving the hydraulic controller; and, an electromagnetic hydraulic control valve configured to change a flowing direction of hydraulic oil to the hydraulic actuator;

wherein the emergency ship steering device is configured to control the hydraulic actuator by operating the electromagnetic hydraulic control valve.

2. The ship steering system for an out-drive device according to claim 1 further comprising a connection terminal configured to detachably connect between wiring of the emergency ship steering device and wiring of the electromagnetic hydraulic control valve, wherein the connection terminal enables the emergency ship steering device to be detachable from the electromagnetic hydraulic control valve.

3. The ship steering system for an out-drive device according to claim 1 further comprising a connection terminal configured to detachably connect between wiring of the hydraulic controller and wiring of the electromagnetic hydraulic control valve, wherein the emergency ship steering device becomes available when the wiring of the emergency ship steering device is connected to the wiring of the electromagnetic hydraulic control valve through the connection terminal.

4. The ship steering system for an out-drive device according to claim 1 further comprising a main controller configured to be capable of recognizing failure of the hydraulic controller, wherein the emergency ship steering device becomes available when the main controller recognizes the failure of the hydraulic controller.

5. The ship steering system for an out-drive device according to claim 2 further comprising a main controller configured to be capable of recognizing failure of the hydraulic controller, wherein the emergency ship steering device becomes available when the main controller recognizes the failure of the hydraulic controller.

* * * * *